US005362029A

United States Patent [19]

Kallenberger

[11] Patent Number: 5,362,029

[45] Date of Patent: Nov. 8, 1994

[54] LIFT LIMIT DEVICE FOR A LOAD LIFTING MECHANISM

[75] Inventor: Harvey J. Kallenberger, Wind Lake, Wis.

[73] Assignee: Harnischfeger Corporation, Brookfield, Wis.

[21] Appl. No.: 4,074

[22] Filed: Jan. 13, 1993

[51] Int. Cl.[5] ..... B66D 1/48; B66C 13/18

[52] U.S. Cl. ..... 254/269; 212/152

[58] Field of Search ..... 254/269, 270; 212/132, 212/152

[56] References Cited

U.S. PATENT DOCUMENTS

| | | | |
|---|---|---|---|
| 1,945,712 | 2/1934 | Wadd | 254/269 |
| 2,266,660 | 12/1941 | Sloan | 254/269 X |
| 3,301,532 | 1/1967 | Cock et al. | 254/269 |
| 3,335,674 | 8/1967 | Kore et al. | 105/163 |
| 3,478,907 | 11/1969 | Dechantsreiter | 214/313 |
| 3,517,761 | 6/1970 | Bartley et al. | 177/147 |
| 3,987,905 | 10/1976 | Dechantsreiter | 212/18 |
| 4,093,184 | 6/1978 | Wieschel | 254/139.1 |
| 4,161,144 | 7/1979 | Raugulis et al. | 105/163 R |
| 4,170,308 | 10/1979 | Rogers | 254/269 X |
| 4,300,134 | 11/1981 | Paciorek | 212/152 X |
| 4,905,849 | 3/1990 | Coull | 212/152 |

FOREIGN PATENT DOCUMENTS

| | | | |
|---|---|---|---|
| 594028 | 2/1978 | U.S.S.R. | 212/152 |
| 678022 | 8/1979 | U.S.S.R. | 212/152 |

*Primary Examiner*—Daniel P. Stodola
*Assistant Examiner*—Michael R. Mansen
*Attorney, Agent, or Firm*—Michael, Best & Friedrich

[57] ABSTRACT

A limit device for preventing travel of a hoist lift rope load above a predetermined height. The limit device includes an actuator mounted at a reference position adjacent the hoist lifting rope as it is raised and lowered by a prime mover. A switch is connected in a control circuit for the prime mover to place the prime mover in either a raise-lower mode or a raise-prevent mode. A switch actuating mechanism is connected between the actuator and the switch and is operatively connected to maintain the prime mover in its raise-lower mode when the actuator is in its reference position. A follower is mounted at any desired fixed position on the lift rope for travel therewith. Lifting of a load above a predetermined height will result in the follower contacting the actuator to move it from its reference position and cause the switch to place the prime mover in its raise-prevent mode and stop further lifting of the load.

18 Claims, 3 Drawing Sheets

LIFT LIMIT DEVICE FOR A LOAD LIFTING MECHANISM

BACKGROUND OF THE INVENTION

The present invention relates to a limit device for restricting the height of travel that a load can be lifted by a load lifting apparatus.

One typical load lifting apparatus is a dragline excavating machine used in open pit mines. This type of machine will be referred to as a dragline. A dragline generally comprises a mobile support that includes a boom 300 to 400 feet long having a sheave rotatably mounted adjacent its top end. A main lift rope of 3.5 to 4.5 inches in diameter is reeved over the sheave, to hang downward therefrom. A dragline bucket is connected to the main lift rope which is raised and lowered at speeds of over 800 feet per minute (when the bucket is not loaded) by a prime mover actuated by the dragline operator. The dragline bucket is frequently raised close to the top of the boom in order to spoil overburden high on a spoil pile or to reclaim a spoil pile.

The dragline operator must not over-lift the bucket beyond a predetermined lift position. The lift travel limit position is variable depending upon such factors as the length of and angle of the dragline boom and the overall vertical distance the bucket must be raised above the bottom of the mine pit. Raising the bucket beyond the lift travel limit position can cause the bucket to contact the boom structure, and this can result in serious damage to the dragline boom and bucket. As a practical matter, if the top end of the boom is 200 feet off the ground and the bucket is lifted at 800 feet per minute, it will take only 15 seconds for the bucket to reach the boom.

One normal procedure for minimizing the risk of such contact is to carefully train the dragline operator to observe when the load has reached the predetermined lift limit position. Draglines in open pit mines normally operate 24 hours a day in all weather conditions, and maximum risk occurs when the operator is forced to look into the sun, when the dragline is operating at night under artificial light, or when the dragline bucket must continually be raised to maximum height in dumping or reaching material from high on a hillside or spoil pile. In such operations, the bucket is repetitively raised at a high rate of speed and the effectiveness of training procedures depends upon visual acuity of the operator, physical response time, accurate visual estimates of distance, and visibility. Even if the operator thinks he has stopped the bucket in time, inertia forces can cause overtravel after control shut-off, in which case destructive contact can occur.

SUMMARY OF THE INVENTION

To minimize the risk of such destructive contact, a need exists for a reliable, rugged, low-cost lift travel limit device that can easily and quickly be set to any desired position to automatically prevent lifting of the load above any predetermined lift position. The wire rope of the dragline is required to make pendulum-type swinging movements during stripping and dumping operations. Therefore a further need exists for a lift travel limit device which will accommodate the required extent of such movement without activating the lift limit device prematurely.

The safety and effective operation of the dragline also depends upon an undamaged wire rope. A dragline can have an operating radius of about 300 feet which places the wire rope too far from the operator for convenient observation to determine if the wire rope is fraying. Therefore, there also exists a need for a lift height limit device that will function to alert the operator that damage to the wire rope, such as fraying, has occurred.

The lift travel limit device of the present invention features an actuator mounted at a reference position for contact by the main lifting element (the rope) as it is raised and lowered by a prime mover that can be placed in either a raise-permitted mode or a raise-prevent mode by a switch. A switch actuating means is connected between the actuator and the switch, and the switch is operatively connected in a control circuit to maintain the prime mover in its raise-permitted mode when the actuator is in its reference position. A follower is mounted at any desired fixed position on the rope for travel therewith. If the operator attempts to lift a load above a limit position as determined by the reference position of the actuator, the follower will contact the actuator to move it from its reference position and cause the switch to place the prime mover in its raise-prevent mode and stop further lifting of the load.

More specifically the actuator includes first and second laterally deflectable means such as stabilizer ropes each having an upper attachment end connectable to a support structure, a depending portion that is positioned in spaced relation to the main lifting element, and a distal end. A contact means such as a sleeve is connected to the distal ends of the first and second ropes. The rope passes through the sleeve and the switch is connected to the sleeve by an actuating means such as a static line which is normally in tension. In operation, if over-lifting is attempted the follower will contact the sleeve to move it from its reference position and relax the static line to cause the switch to place the prime mover in its raise-prevent mode.

DESCRIPTION OF THE PREFERRED EMBODIMENT

Figures 1, 5:
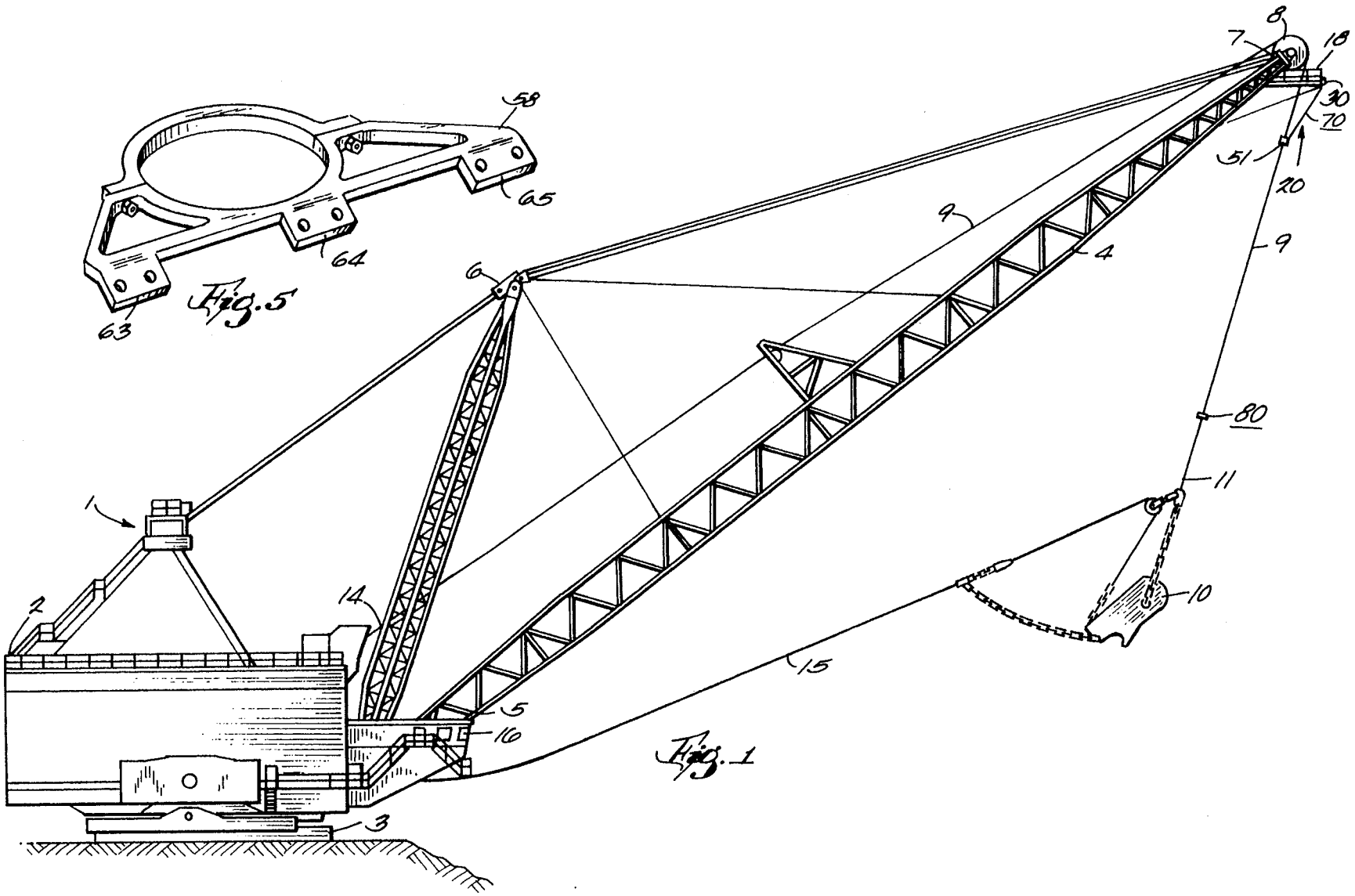
FIG. 1 is a side elevation view of a dragline incorporating the load lifting device of the present invention.
FIG. 5 is an isometric projection view of a collar shown in FIGS. 2 and 3.

FIG. 1 shows a dragline 1 having a main frame 2, which has a walking mechanism 3 operable in known manner to move the dragline 1. A boom 4 is mounted at its lower end 5 on main frame 2. A mast assembly 6 is provided to support the upper end 7 of boom 4 to raise and lower it in known manner. A sheave 8 is rotatably mounted on the upper end 7 of boom 4 and an elongated lifting element such as a wire rope 9 is reeved over sheave 8. An excavating bucket 10 is suspended from one end 11 of rope 9. A conventional hoist mechanism 12 (FIG. 6) is provided on main frame 2 and energized by a prime mover 13. The other end 14 of rope 9 is connected to the hoist 12 which is operated in known manner to raise and lower rope 9 and the bucket 10.

A bucket pull line 15 is connected to bucket 10 and operated by conventional drum winding machinery (not shown) within main frame 2 to pull the bucket 10, when it is on the ground, toward the main frame 2. The dragline 1 has an operator station 16 at which a standard raise-lower operator actuated control 17 (shown in FIG. 6) is located. The control 17 activates prime mover 13 to either raise or lower the bucket 10 in known manner. A support, comprising platform 18, is mounted at the upper end 7 of boom 4. The dragline 1 as thus far described is conventional and will not be described in greater detail.

Figures 2, 3, 4:
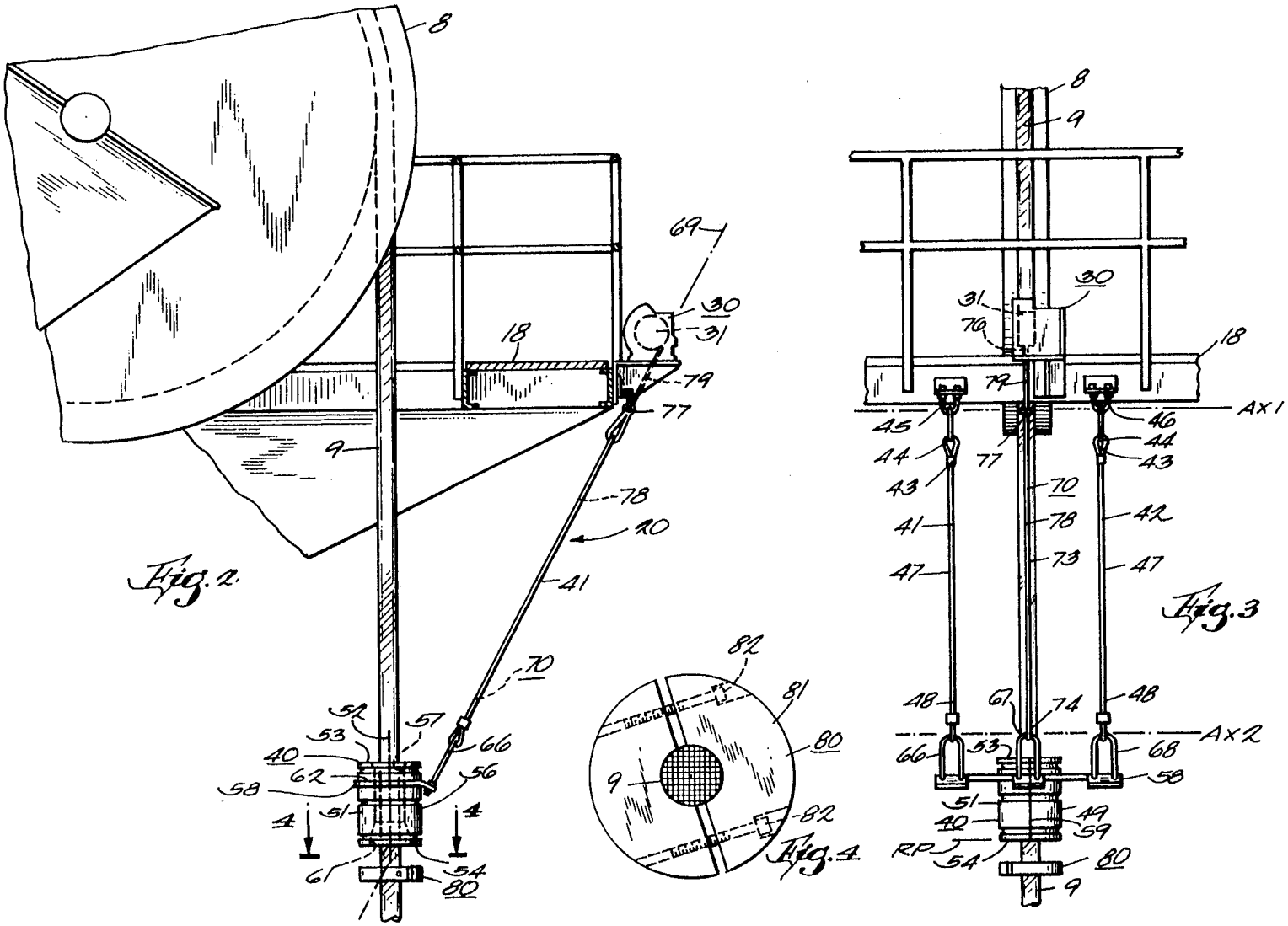
FIG. 2 is an enlarged side view of an upper portion of the boom of the dragline shown in FIG. 1.
FIG. 3 is a front view of the upper boom portion shown in FIG. 2.
FIG. 4 is a sectional view taken along line 4—4 of FIG. 2.

The dragline 1 also has a lift travel limit device 20 for limiting the vertical travel of main lifting rope 9 to prevent bucket 10 from coming into contact with the end 7 of boom 4. The limit device 20 is best shown in FIGS. 2 and 3 and generally comprises a switch means 30, an actuator means 40, a switch actuating means 70, and a follower means 80. Each of these components will now be described in further detail.

Figure 6:
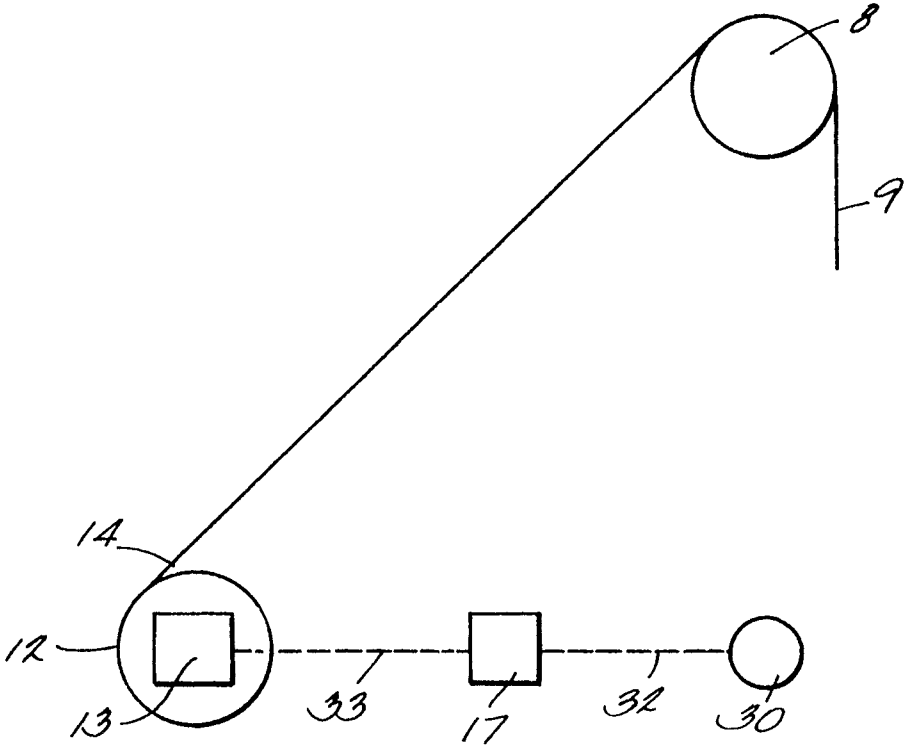
FIG. 6 is a schematic control circuit of the lift limit device.

Referring to FIGS. 2, 3 and 6, the switch means 30 includes a mechanically activated on-off switch element 31 operatively connected in an electrical control circuit 32, 33 (see FIG. 6) that also includes operator control 17 for the prime mover 13. The switch element 31 is normally biased and connected to place the prime mover 13 in a raise-lower or raise-permitted mode responsive to operator actuated control 17. The switch means 30 is mounted on the service platform 18 carried by the boom 4.

The actuator means 40 (FIGS. 2 and 3) is also mounted on the service platform 18. The actuator means 40 includes first and second laterally deflectable stabilizing means or members such as wire ropes 41, 42. Each of the wire ropes 41, 42 has at its upper end 43, an attachment means 44, such as an upper eye-loop and ring assembly connected to upper U-bolts 45, 46 respectively, which provides a semi-universal connection to the service platform 18 at generally opposite sides of the main lifting rope 9; a depending portion 47 positioned in laterally spaced radially offset relation to the main lifting rope 9; and a distal end 48. A contact means 49 is connected between the distal ends 48 at a reference position RP. The contact means 49 includes a sleeve 51 of wear-resistant, low-friction material having an axis 52 (FIG. 2), axially spaced upper and lower ends 53, 54, an outer surface 56, and an axially extending bore 57 dimensioned to freely receive the main lifting rope 9 therein. The contact means 49 also includes a collar 58 (best shown in FIG. 5) which may be mounted on the outer surface 56 for rotational movement relative to the sleeve 51. The outer surface 56 of the sleeve 51 may be provided with a peripheral slot 62 with the collar 58 slidably mounted in the slot 62. The locations of slot 62 and the connection points 63, 64, 65 (FIG. 5) for U bolts 66, 67 and 68 (FIG. 4) on collar 58 are selected relative to the center of gravity of sleeve 51 such that a uniform reaction load exists on the sleeve 51 so that it will, when suspended on ropes 41 and 42, maintain itself in vertical plumb position with bore axis 52 parallel to the main lift rope 9. This results in minimum frictional contact between the main lift rope 9 and sleeve 51, thereby reducing wear on the sleeve 51 and the reaction rotational forces applied to sleeve 51 due to its contact with the spiral winding of the wire strands in the main lift rope 9. The sleeve 51 may be axially split at 59 and secured together by cap screws (not shown) to facilitate its mounting around the main lifting rope 9. The bore 57 preferably has a tapered or flared portion 61 at its lower end for guiding the main lifting rope 9. In other words, the sleeve lower end has a tapered lead-in geometry for guiding the rope 9 into the sleeve bore 57. While the laterally deflectable means are shown as first and second ropes 41 and 42, other means could also be used to suspend the lower end 54 of sleeve 51 at the desired reference position RP.

The distal ends 48 of the first and second rope members 41, 42 are connected by eye-loops to the lower U-bolts 66, 68 respectively, on opposite sides of the collar 58. The upper and lower U-bolts 45, 46 and 66, 68 lie in a first plane 69 as shown in FIG. 2. The upper U-bolts 45, 46 are in alignment along a horizontal first axis AX1 and lower U-bolts 66, 68 are in alignment along a second horizontal axis AX2.

Still referring to FIGS. 2 and 3 and as previously explained, the switch means 30 is mounted on platform 18 and includes on-off switch element 31 normally biased to a first position placing the prime mover in its normal raise-lower mode. The switch actuating means 70 is connected to control the switch element 31. The switch actuating means 70 includes (see FIG. 3) a static line 73 connected at its lower end 74 to bottom U-bolt 67, which is carried by collar 58 for pivotal movement about axis AX2. The static line 73 is connected at its upper end 76 to switch element 31. Preferably the switch actuating means 70 will also include a guide means in the form of an eye bolt 77 mounted on platform 18 through which static line 73 is threaded. As shown in FIG. 3, the eye bolt 77 divides static line 73 and creates a first lower run 78 from eye bolt 77 to bottom U-bolt 67 and a second upper run 79 from eye bolt 77 to switch element 31. As shown in FIG. 2 the eye bolt 77 and lower U-bolt 67 also lie in the first plane 69. The eye bolt 77 is also on axis AX1. The static line 73 has a length such that when connected it will be in tension to hold the switch element 31 in position to maintain the prime mover in its raise-lower mode.

As best shown in FIGS. 2, 3 and 4 the follower means 80 comprises a diametrically-split disk or collar 81 that can be fixedly clamped at any desired position on the main lift rope 9 by tightening releasable cap screws 82. The follower means 80 could also include any type of fitting permanently secured to the main lift rope 9 for use in an installation where the position of the follower 80 need not be adjusted.

Referring to FIGS. 1 and 6, in operation the follower means 80 will be secured at a desired position below the contact means 49 on the main lift rope 9 which, as previously described, freely passes through contact means sleeve 51. The prime mover 13 will be in its normal operating raise-lower mode because the switch element 31 will be biased to its first position due to tension on static line 73. If the operator attempts to over-lift the main lift rope 9 past a predetermined lift position the follower means 80 will come into contact with the lower end 54 of the contact means sleeve 51, thus raising it and creating slack in static line 73. This slack permits the switch element 31 to be moved by its normal bias to its second position, thus placing the prime mover 13 in a raise-prevent mode which automatically stops the lifting travel of main lift rope 9. When the prime mover is in its raise-prevent mode, the prime mover control 17 and the prime mover remain operable to permit the operator to lower the bucket 10. Lowering of the bucket 10 moves follower 80 away from contact sleeve 51 and thus re-tensions static line 73. This returns the switch element 31 to its first position and thereby automatically returns the prime mover 13 to its raise-lower mode.

The first and second ropes 41, 42 and collar 58 prevent static line 73 from becoming twisted around main lifting rope 9. The alignment of guide means or eye bolt 77 on axis AX1 enables the main lifting rope 9 to move off a vertical position a limited amount during pendulum swinging action without affecting the tension on static line 73. This prevents actuation of switch element 31 during normal pendulum swinging of the lift rope 9.

The ropes 41, 42 also help prevent undesirable vertical, forces on the static line 73. For example, when wire strands of the main rope 9 break they project laterally away from the axis of the main lifting rope 9 and engage sleeve 51 as the lifting rope 9 moves through the sleeve 51. When the main rope 9 moves downwardly, projecting strands exert a downward force on sleeve 51, and when the main rope 9 moves upwardly, projecting strands exert an upward force on sleeve 51. The ropes 41, 42 oppose any downward force on sleeve 51 and thereby prevent excessive tension on static line 73, which tension could damage the switch 30. The ropes 41, 42 are also sufficiently rigid to resist an upward force on sleeve 51 due to friction between the rope 9 and the sleeve 51 or due to projecting strands.

As mentioned above, when the main rope 9 moves upwardly, projecting strands exert an upward force on sleeve 51. If the number of strands or their projection from the rope 9 becomes sufficient they will raise sleeve 51 to cause switch means 30 to place the prime mover 13 in the raise-prevent mode. This will alert the operator of the existence of broken strands in the main lifting rope 9.

The lift limit device 20 is shown embodied in a dragline excavating machine 1 by way of example. The limit device 20 could be used in any type of hoist means having a lift rope to prevent the lifting thereof past a predetermined point.

I claim:

1. A load lifting apparatus comprising a support, a hoist which is mounted on said support and which includes a prime mover, and an elongated lifting element for selective load raising and lowering movement upon activation of said prime mover, and a limit device for deactivating said prime mover to prevent travel of said lifting element above a predetermined lift position, said limit device comprising a switch means mounted on said support for actuation to place said prime mover in either a raise-permit mode or a raise-prevent mode, an actuator including a contact and means for supporting said contact relative to said support at a reference position, a switch actuating means connected between said contact and said switch means for maintaining said prime mover in said raise-permit mode when said contact is in said reference position, said switch actuating means being separate from said means for supporting said contact relative to said support at said reference position, and a follower mountable at any desired fixed position on said lifting element for travel therewith and into contact with said contact when said lifting element reaches said predetermined lift position to move said contact from said reference position and cause said switch actuating means to actuate said switch means and place said prime mover in said raise-prevent mode.

2. The combination of claim 1 wherein said switch actuating means includes a static line normally connected in tension between said contact and said switch means.

3. The combination of claim 2 wherein said switch actuating means also includes a guide mounted on said support in contact with said static line intermediate said contact and said switch means.

4. The combination of claim 1 wherein said actuator includes first and second laterally deflectable stabilizing members each having an upper attachment connected to said support, a depending portion positioned in spaced relation to said elongated lifting element, and a lower distal end, said contact being connected to said lower distal ends of said first and second laterally deflectable members.

5. The combination of claim 4 wherein said upper attachments are connected to said support for pivotal movement about an upper horizontal axis and said lower distal ends are connected for pivotal movement about a lower horizontal axis.

6. The combination of claim 5 wherein said switch actuating means includes a static line normally connected in tension between said contact and switch means, and a guide mounted on said support to lie on said upper horizontal axis and in contact with said static line intermediate said contact and switch means.

7. The combination of claim 6 wherein said static line has a first run between said contact and said guide and a second run between said guide and said switch means, and wherein said first and second laterally deflectable members and said first run lie in a single plane.

8. The combination of claim 4 wherein said contact includes a sleeve having an axis, axially spaced upper and lower ends, an outer surface, and an axially extending bore for freely receiving the elongated lifting element therein, and said contact includes a collar mounted on said sleeve, and wherein said distal ends and said switch activating means are connected to said collar.

9. The combination of claim 8 wherein said sleeve outer surface includes a peripheral slot extending transversely of said axis, and wherein said collar is slidably mounted in said peripheral slot.

10. The combination of claim 8 wherein said sleeve lower end has a tapered lead-in geometry for guiding said elongated lifting element into said sleeve bore.

11. The combination of claim 4 wherein said switch actuating means includes a static line normally connected in tension between said contact and said switch means, and a guide mounted on said support in contact with said static line intermediate said contact and said switch means.

12. The combination of claim 1 wherein said support includes a crane boom having a sheave rotatably mounted thereon, wherein said elongated lifting element includes a rope reeved over said sheave to depend therefrom, and wherein said actuator includes an attachment having an upper end connected to said crane boom, a depending portion in spaced relation to said depending rope, and a distal end, said contact being connected to said distal end, said contact having therein a bore through which said rope freely passes.

13. The combination of claim 12 wherein said attachment includes first and second rope members each having an upper attachment end connected to said crane boom, a depending portion in spaced parallel relation to said rope, and a distal end, and wherein said contact is connected between said distal ends of said first and second rope members.

14. The combination of claim 12 wherein said first and second rope members are connected on opposite axial sides of said contact.

15. A hoist mechanism having a lifting travel limit device, said mechanism comprising:

a support;

a hoist drum mounted on said support;

an elongated lifting element connected to said hoist drum to be raised and lowered thereby;

a prime mover operably connected to drive said hoist drum;

a switch means on said support activatable to place said prime mover in either a hoist drum raise-permit mode or a hoist drum raise-prevent mode;

an actuator mounted on said support at a reference position in contact with said lifting element during the raising and lowering thereof;

a switch actuating means including a static line normally connected in tension between said actuator and said switch means for causing said switch means to place said prime mover in the raise-permit mode when said actuator is in said reference position, said switch actuating means also including a guide mounted on sand support in guiding contact with said static line intermediate said actuator and said switch means; and a follower mounted at any desired fixed position on said lifting element for travel therewith and into contact with said actuator when said lifting element reaches a predetermined lift position to move said actuator from said reference position and cause said switch actuating means and said switch means to place said prime mover in said raise-prevent mode.

16. The combination of claim 15 wherein said actuator includes first and second laterally deflectable members each having an upper attachment connected to the support, a depending portion positioned in spaced relation to said elongated lifting element, and a lower distal end, said actuator including a contact connected to said lower distal ends of said first and second laterally deflectable members.

17. The combination of claim 16 wherein said upper attachments are connected for pivotal movement about an upper horizontal axis, wherein said guide is located on said upper axis, and wherein said lower distal ends are connected for pivotal movement about a lower horizontal axis.

18. A limit device to prevent travel of a hoist mechanism lifting element above a predetermined lift position by deactivating a prime mover that drives the hoist mechanism, said device comprising:

a switch means for placing the prime mover in either a raise-permit or a raise-prevent mode;

an actuator adapted to be connected to a support for engagement by the lifting element as the lifting element is raised and lowered, said actuator including first and second laterally deflectable members each having an upper attachment adapted to be connected to the support, a depending portion positioned in spaced relation to lifting element, and a lower distal end, said actuator also including a contact connected to said lower distal ends of said first and second laterally deflectable members, said contact including a sleeve having an axis, axially spaced upper and lower ends, an outer surface, and an axially extending bore for freely receiving the lifting element therein, said sleeve outer surface including a peripheral slot extending transversely of said axis, and said contact also including a collar slidably mounted in said peripheral slot, said distal ends being connected to said collar;

a switch actuator connected between said collar and said switch means; and a follower mountable at any desired fixed position on the lifting element for travel therewith and contactable with said contact when the lifting element reaches the predetermined lift position to cause said switch actuator and said switch means to place the prime mover in the raise-prevent mode.

* * * * *